US005121464A

United States Patent [19]

Hanada et al.

[11] Patent Number: 5,121,464

[45] Date of Patent: Jun. 9, 1992

[54] A STEAMER WITH CONTROLLED PRESSURE

[75] Inventors: Touru Hanada, Takarazuka; Yoshiyuki Ujino, Nishinomiya, both of Japan

[73] Assignee: Matsushita Electric Industrial Co., Ltd., Osaka, Japan

[21] Appl. No.: 513,457

[22] Filed: Apr. 19, 1990

[30] Foreign Application Priority Data

Apr. 24, 1989 [JP] Japan ..... 1-103805
Apr. 24, 1989 [JP] Japan ..... 1-103807

[51] Int. Cl.[5] ..... A61H 33/12; D06F 71/00; F17C 7/04

[52] U.S. Cl. ..... 392/405; 392/404; 38/77.81

[58] Field of Search ..... 392/394, 403–406; 38/69, 77.1, 77.5, 77.7, 77.8, 77.81, 77.82, 77.83

[56] References Cited

U.S. PATENT DOCUMENTS

| | | | |
|---|---|---|---|
| 2,620,576 | 12/1952 | Stevenson et al. | 38/77.83 |
| 3,372,499 | 3/1968 | Gilbert . | |
| 3,395,469 | 8/1968 | Gilbert . | |
| 3,436,851 | 4/1969 | Gilbert . | |
| 3,436,852 | 4/1969 | Stansbury | 38/77 |
| 3,470,719 | 10/1969 | Frank . | |
| 3,485,065 | 12/1969 | Frank . | |
| 3,546,428 | 12/1970 | Omohundro . | |
| 3,733,723 | 5/1973 | Takakuwa et al. . | |
| 3,755,649 | 8/1973 | Osrow . | |
| 3,823,497 | 7/1974 | Solomon | 392/405 |
| 4,459,771 | 7/1984 | Ogata | 38/77.3 |
| 4,516,011 | 5/1985 | Jeffress et al. | 392/405 |
| 4,586,278 | 5/1986 | Cavalli | 38/77.81 |
| 4,616,122 | 10/1986 | Burian et al. | 38/77.83 |
| 4,646,451 | 3/1987 | Nakao et al. | 38/77.3 |
| 4,656,763 | 4/1987 | Kawasaki et al. | 38/77.7 |
| 4,688,339 | 8/1987 | Tsai | 38/77.7 |
| 4,939,857 | 7/1990 | Biancalani | 38/77.83 |

FOREIGN PATENT DOCUMENTS

| | | |
|---|---|---|
| 1878818 | 7/1963 | Fed. Rep. of Germany . |
| 3603229 | 8/1986 | Fed. Rep. of Germany . |
| 466494 | 8/1971 | Japan . |
| 522030 | 10/1977 | Japan . |
| 5431559 | 1/1979 | Japan . |

OTHER PUBLICATIONS

German Office Action dated Aug. 12, 1991, with English translation.

*Primary Examiner*—Bruce A. Reynolds
*Assistant Examiner*—John A. Jeffery
*Attorney, Agent, or Firm*—Panitch Schwarze Jacobs & Nadel

[57] ABSTRACT

A steamer for use in ironing clothes, in which when the pressure in the vaporizing chamber exceeds a predetermined value, the water supply is stopped for the vaporizing chamber even if the user operates the pump excessively, thereby preventing unvaporized hot water from escaping and either scalding the user and wetting the material being ironed.

17 Claims, 6 Drawing Sheets

STEAMER WITH CONTROLLED PRESSURE

BACKGROUND OF THE INVENTION

1. Field of the Invention

The present invention relates to a steamer for use as an iron.

2. Description of the Prior Art

It is generally known that irons or pressers apply steam and pressure, sometimes with the addition of water, to clothes so as to remove wrinkles. However, it is also known that the heat and pressure tend to damage the delicate features and property of the clothes. To solve this problem, the recent practice is to iron clothes without applying pressure but only with steam.

For example, U.S. Pat. No. 3372499, No. 3436851, No. 3755649, No. 3470719, No. 3485065 and No. 3546428 disclose irons using steam. These known irons have a major difficulty in switching between the ejection and stopping of steam while the irons are in use. In addition, unvaporized hot water leaks through the irons when they are tilted to eject steam against the clothes. The users are in danger of being scalded and the clothes are also in danger of being dampened.

To solve the problems resulting from the leakage of scalding hot water, U.S. Pat. No. 3733723 proposes a steamer having a tank and a vaporizing chamber separated from the tank, the water in the tank being forced into the vaporizing chamber. This expedient is effective to prevent the hot water from spilling even if the steamer is tilted or turned upside down. Nevertheless, this steamer has not solved the difficulty in effecting the easy changeover between the ejection and stopping of steam. To achieve the easy changeover, the steamers have sacrificed the handiness.

There are another type of steamers which are provided with a manually-operated pump for supplying a required amount of water from the tank to the vaporizing chamber where necessary. These steamers are disclosed in U.S. Pat. No. 3395469, Japanese Patent Publications No. 52-2030, No. 54-31559, and Japanese Laid-open Patent Publication No. 46-6494. They are advantageous in that an adequate amount of steam is supplied for ironing clothes, thereby avoiding generating steam excessively. However, the following disadvantages arise:

1. Consciously or unconsciously, the iron user tends to work the pump excessively, thereby supplying water in excess to the vaporizing chamber. As a result, the temperature in the tank suddenly drops and the supplied water is ejected before being vaporized. This ejection of hot water results from an unexpected rise in pressure in a pipe connecting between the pump and the vaporizing chamber.

2. The user suddenly encounters a scalding accident, especially when he is not aware of his pumping excessively.

SUMMARY OF THE INVENTION

The steamer of the present invention, which overcomes the above-discussed and numerous other disadvantages and deficiencies of the prior art, comprises a casing, a vaporizing chamber in the casing, a water tank mounted on the casing, a water supply means for supplying the water in the tank to the vaporizing chamber, a water channel connecting the tank and the vaporizing chamber, a valve means for preventing the water from returning to the tank, the valve means being located in the water supply means toward the tank, and a return-flow means for returning the water supplied by the water supply means to the tank when the pressure in the vaporizing chamber exceeds a predetermined value.

In a preferred embodiment, the water supply means and the return-flow means are made in one piece.

In a preferred embodiment, the return-flow means is provided on the tank, and wherein the return-flow means is connected to the water supply means.

In a preferred embodiment, the return-flow means is provided in a water channel connecting a first point of the water supply means toward the vaporizing chamber and a second point thereof toward the tank.

In a preferred embodiment, the return-flow means comprises a channel such that the water in the tank is returned to the tank from a point where the water is supplied to the water supply means.

In a preferred embodiment, the water supply means comprises a pump unit including cylinder, a piston reciprocally movable in the cylinder, and a switch for manually operating the piston.

In an alternately preferred embodiment, the water supply means is electrically operated.

According to another aspect of the present invention, the steamer comprises a casing, a vaporizing chamber in the casing, a water tank mounted on the casing, a pump means for supplying the water in the tank to the vaporizing chamber, a water channel connecting the tank and the vaporizing chamber, a first valve means for preventing the water from returning to the pump means, the first valve means being disposed in the pump means toward the vaporizing chamber, a second valve means for preventing the water from returning to the tank, the second valve means being disposed in the pump means toward the tank, and a third valve means for returning the water in the pump means to the tank when the pressure in the vaporizing chamber exceeds a predetermined value or when the channel connection between the pump means and the vaporizing chamber is closed.

According to a further aspect of the present invention, a steamer for use in ironing clothes, the steamer comprising a casing, a vaporizing chamber in the casing, a water tank mounted on the casing, a pump means for supplying the water in the tank to the vaporizing chamber, a first water channel connecting the pump means and the tank, a second water channel connection between the pump means and the vaporizing chamber, a first valve means for preventing the water from returning to the pump means, the first valve means being disposed in the pump means toward the vaporizing chamber, a second valve means for preventing the water from returning to the tank, the second valve means being disposed in the pump means toward the tank, and a third valve means for returning the water in the pump means to the tank when the pressure in the vaporizing chamber exceeds a predetermined value or when the channel connecting the pump means and the vaporizing chamber is closed, the second valve means and the third valve means being disposed in the first water channel.

According to a still further aspect of the present invention, the steamer comprises a casing, a vaporizing chamber in the casing, a water tank detachably mounted on the casing, a water supply means for supplying the water in the tank to the vaporizing chamber, a stopping means for keeping the water supply means inoperative in response to the dismount of the tank from the casing.

In a preferred embodiment, the casing comprises a grip portion having a sufficient space to accommodate the tank in a detachable manner.

According to another aspect of the present invention, the steamer comprises a vaporizing chamber heated by a heater, a steam ejecting section for ejecting the steam generated in the vaporizing chamber, a water supply means for supplying the water in the tank to the vaporizing chamber, a water channel connection between the water supply means and the vaporizing chamber, a valve means for closing or opening the water channel in response to changes in the temperatures of the vaporizing chamber, the valve means including a bimetal-fuse whereby the opening or closing of the water channel is quickly performed.

In a preferred embodiment, the vaporizing chamber is covered with a cover made of a metallic thermal conductor, and the cover comprising a bimetal-fuse.

According to a further aspect of the present invention, the steamer comprises a casing, a vaporizing chamber, a tank having a water intake port, a pump means for supplying the water in the tank to the vaporizing chamber, an air intake valve for taking in air in accordance with a reduction in the pressure in the tank, a plug for closing or opening the water intake port, the air intake valve and the cover being made in one piece.

In a preferred embodiment, the air intake valve is located under the water in the tank at a point adjacent to the water intake, and wherein the cover is connected to the air intake valve.

According to a still further aspect of the present invention, the steamer comprising a casing, a vaporizing chamber housed in the casing, a tank detachably mounted in the casing, a water channel connection the tank and the vaporizing chamber, a water supply means for supplying water in the tank to the vaporizing chamber, a first stopping means for closing the water channel and stopping the water supply for the vaporizing chamber in response to changes in the temperatures of the vaporizing chamber port, and a second stopping means for keeping the water supply means inoperative when the tank is dismounted from the casing.

According to another aspect of the present invention, the steamer comprises a casing, a vaporizing chamber, a tank detachably mounted on the casing, a water supply means for supplying the water in the tank to the vaporizing chamber, a water channel connection the tank and the vaporizing chamber, a valve means for preventing the water from returning to the tank, the valve means being disposed on the water supply means toward the tank, a return-flow means for returning the water in the water supply means to the tank when the pressure in the vaporizing chamber exceeds a predetermined value, and a stopping means for keeping the water supply means inoperative when the tank is dismounted from the casing.

Thus, the invention described herein makes possible the objectives of (1) providing a steamer capable of preventing an excessive amount of water from being supplied to the vaporizing chamber even if the user erroneously continues to work the pump; (2) providing a steamer capable of stopping the water supply for the vaporizing chamber when the vaporizing chamber cools to a water unvaporizable temperature; and (3) providing a steamer capable of sending the water in the pump unit to the tank when an excessive water supply is prevented for the vaporizing chamber.

BRIEF DESCRIPTION OF THE DRAWINGS

This invention may be better understood and its numerous objects and advantages will become apparent to those skilled in the art by reference to the accompanying drawings as follows.

DESCRIPTION OF THE INVENTION

Figure 1:
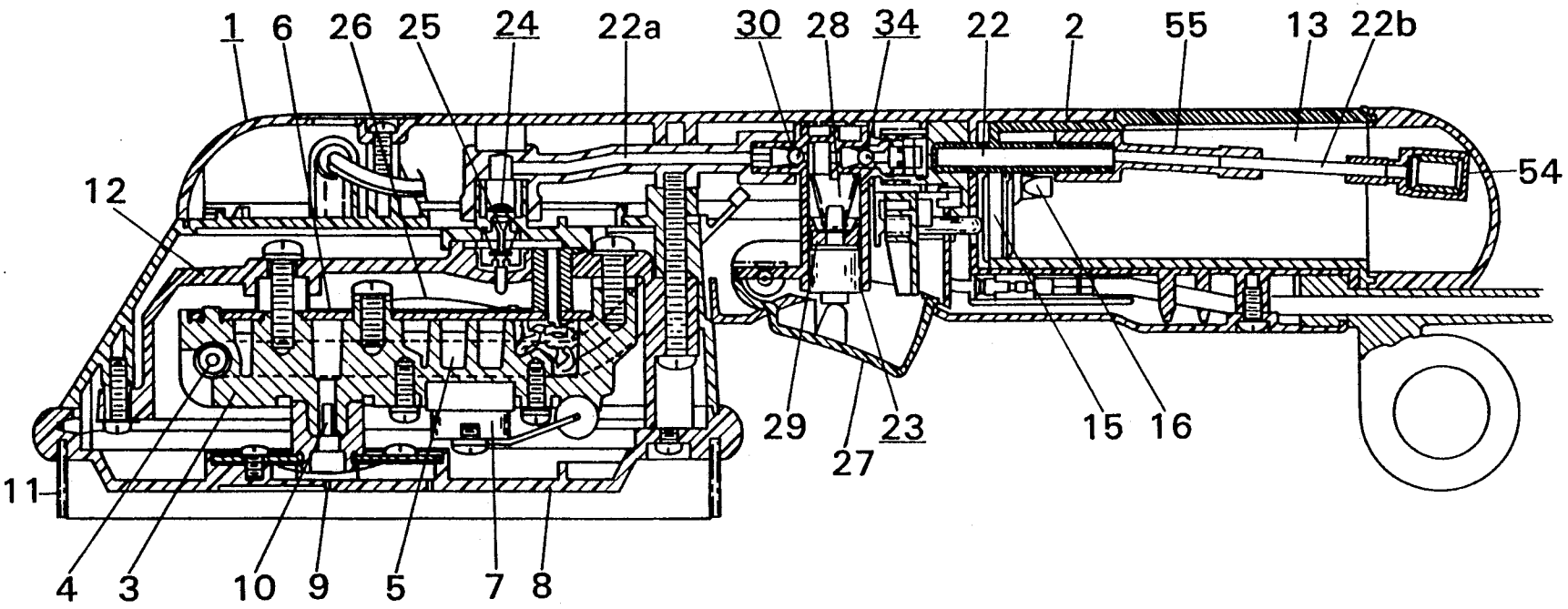
FIG. 1 is a cross-sectional view on an enlarged scale showing a steamer according to the present invention.

In the drawings the reference numeral 1 denotes a casing made of synthetic resin including a handle 2 of a hollow body. The casing 1 includes a vapor cask 3 made of light metal such as aluminum, having a heating element 4 embedded therein. The vapor cask 3 includes a vaporizing chamber 5 bent such as in a zigzag form, which is closed by a lid 6 of a thermal conductor such as aluminum. The vapor cask 3 is provided with a thermostat 7 whereby the temperature in the vaporizing chamber 5 is adjusted to an optimum value for vaporizing water. The vapor cask 3 is covered with a cover 8, which is secured to the casing 1 with a plurality of steam ejection holes 9. There is provided a path 10 which connects the steam ejection holes 9 and an outlet of the vaporizing chamber 5. The steam is ejected through the holes 9 by way of the path 10. The reference numeral 11 denotes brushes for brushing the clothes being ironed with the hot steam. The casing 1 is protected against becoming overheated by a shield 12 made of a heat-proof material such as phenol resin. The vapor cask 3 is secured to the casing 1 through the shield 12.

Figure 6:
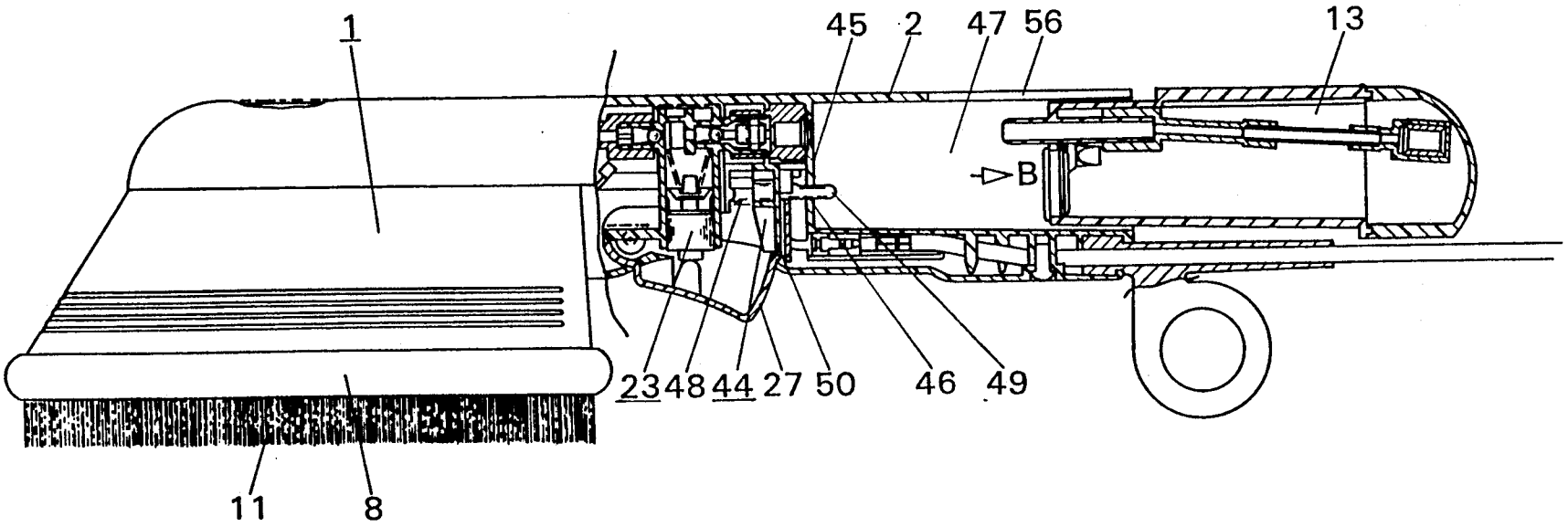
FIG. 6 is a cross-sectional view showing a stopping means for keeping the water supply unit inoperative.
Figure 7:
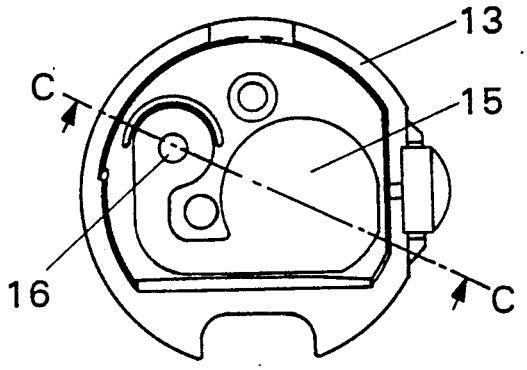
FIG. 7 is a side view showing a tank in the direction of (B) in FIG. 6.
Figure 8:
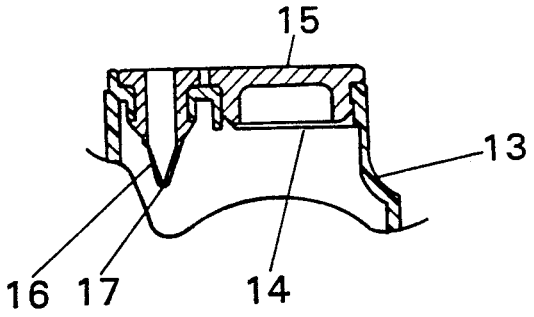
FIG. 8 is a cross-sectional view taken along the line C—C in FIG. 7.

There is provided a tank 13 which is detachably mounted in the handle 2. Water is poured into the tank 13 through a port 14, which is closed with a plug 15 of rubber moldings. The plug 15 is provided with an air intake valve 16 normally inserted in the tank 13 as shown in FIGS. 6 and 7. The air intake valve 16 is maintained in the tank 13 so that it is kept safe from collision with the plug 15 when the plug 15 is rotated to close or open the port 14. The top portion 17 (FIG. 8) of the air intake valve 16 is slotted so as to open when the pressure in the tank 13 drops, but normally it is closed to stop the leakage of water from the tank 13.

Figure 9:
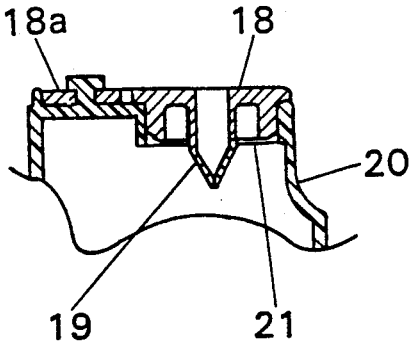
FIG. 9 is a cross-sectional view showing a tank including a modified version of the water intake valve.

FIG. 9 shows a modified version of the air intake valve 16 wherein a lid 18 and an intake valve 19 are formed in one piece. The lid 18 includes one end 18*a* secured to a tank 20, thereby ensuring that the lid 18 is constantly secured to the tank 20 even when the water intake port 21 is opened.

Referring again to FIG. 1, there is provided a water path 22, including a pump unit 23 for supplying water from the tank 13 to the vaporizing chamber 5. The water path 22 includes a first channel 22*a* connecting the pump unit 23 and the vaporizing chamber 5, and a second channel 22*b* connecting the pump unit 23 and the tank 13.

The first water channel 22*a* includes a valve unit 24 opened or closed in response to changes in the temperature of the vaporizing chamber 5. The valve unit 24 is normally biased to close the first channel 22*a* by a spring 25. The lid 6 of the vaporizing chamber 5 is provided with a bimetal-fuse 26 which reacts in response to a rise in the temperature of the vaporizing chamber 5; more specifically, it is normally biased toward the lid 6 but if the temperature in the vaporizing chamber 5 rises beyond a water vaporizable temperature, it is displaced in the opposite direction of the lid 6 to open the valve unit 24. Thus the first channel 22*a* is ready for passing the water through. In this situation, if the pump unit 23 is operated, the water in the tank 13 is introduced into the vaporizing chamber 5 through the water channel 22*a*.

If the vaporizing chamber 5 cools below a predetermined temperature, that is, a temperature at which the vaporization is not effected. the bimetal-fuse 26 is displaced toward the lid 6 by a spring 25, thereby enabling the valve unit 24 to close the first channel 22*a*. Thus the water supply to the vaporizing chamber 5 is stopped.

Figure 2:
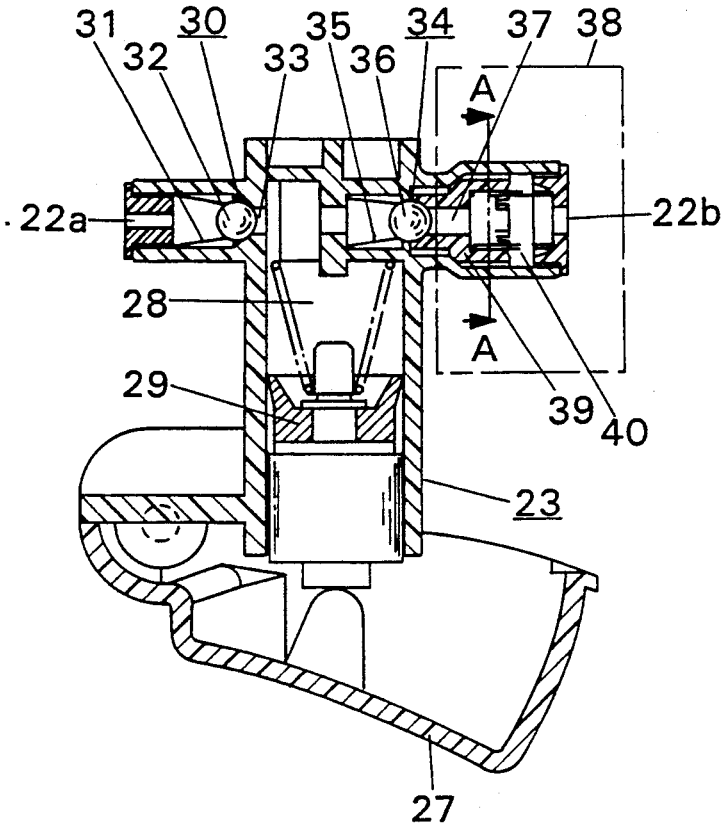
FIG. 2 is a cross-sectional view showing a return-flow unit on an enlarged scale.

The operation of the pump unit 23 is started by operating a trigger 27 disposed on the underside of the handle 2. The trigger 27 is pressed by the user's fingers grasping the handle 2. The pump unit 23 includes a cylinder 28 connecting the first and second water channels 22*a* and 22*b*, and a piston 29 reciprocally movable in the cylinder 28. The actuation of the trigger 27 drives the piston 29. The pump unit 23 is provided with a first check valve 30 which prevents the water forced by the pump unit 23 from returning into the cylinder 28. As shown in FIG. 2, the first check valve 30 includes a ball 32 biased by a spring 31 to close a water outlet 33 from the side of the vaporizing chamber 5. The pump unit 23 is provided with a second check valve 34 which prevents the water entering the pump unit 23 through the second water channel 22*b* from returning into the tank 13. The second check valve 34 includes a ball 36 biased by a spring 35 to close a water intake port 37 from the side of the pump unit 23.

Referring to FIG. 2, the second water channel 22*b* includes a return-flow unit 38, which functions as a third valve in association with the second check valve 34. More specifically, the return-flow unit 38 is constituted as a return-flow valve 39 having an entrance 37 which is closed or opened by the ball 36. The return-flow valve 39 is formed as a part of the pump unit 23 and being normally biased toward the pump unit 23 by a spring 40, which is stronger than the spring 35 for the second check valve 34 so that the return-flow valve 39 overcomes the second check valve 34 to close the second water channel 22*b*.

As described above, the spring 40 for the return-flow valve 39 is stronger than the spring 31 for the first check valve 30 so that the operation of the pump unit 23 opens the first check valve 30 to allow the water to flow into the vaporizing chamber 5.

Figure 5:
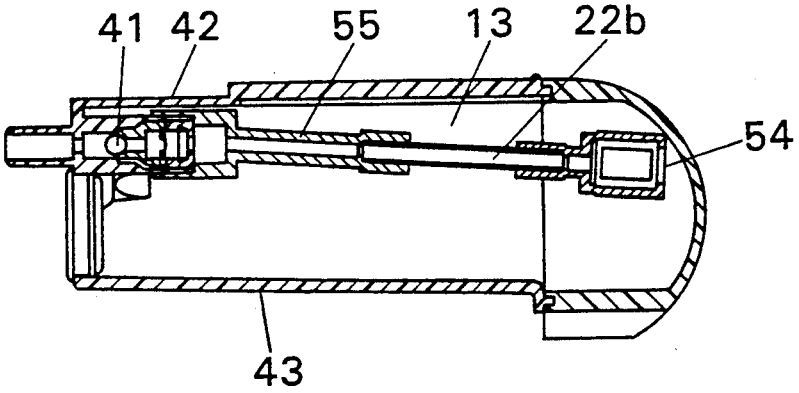
FIG. 5 is a cross-sectional view showing a tank including a modified version of the return-flow unit.

FIG. 5 shows a modified version of the return-flow unit 38 in which a second check valve 41 and a return-flow valve 42 are formed in one piece with a tank 43. This construction facilitates the connection of the tank 43 to the pump unit 23.

Referring to FIG. 6, there is provided a movable member 44 projectable into a tank accommodation chamber 47 through a hole 46 produced in a wall 45 of the handle 2; more specifically, the top portion 49 of the movable member 44 is biased by a spring 48 into the chamber 47. The movable member 44 is supported by a support 50 opposedly to the inside of the trigger 27. When the top portion 49 of the movable member 44 is projected in the tank accommodation chamber 47, the support 50 comes into abutment with the trigger 27 as shown in FIG. 6, thereby preventing the trigger 27 from moving. When the tank 13 is mounted in the chamber 47, the top portion 49 of the movable member 44 is pushed back, thereby causing the support 50 to move to the left (in FIG. 6). In this way the trigger 27 is released from the support 50 and becomes movable. In this way the movable member 44 keeps the trigger 27 in an inoperative state or in an operative state in response to the mount and dismount of the tank 13 on the casing 1.

Figure 10:
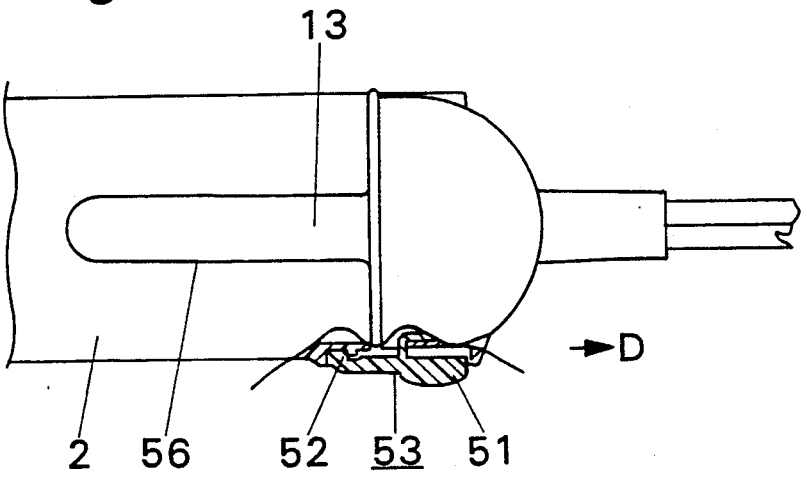
FIG. 10 is a cross-sectional view showing a main portion of the tank of FIG. 9.

The steamer is operated as follows:

Referring to FIG. 10, the tank 13 is provided with a lock unit 53 which consists of a lock 51 and a catch 52. When the rear portion of the tank 13 is grasped, the lock 51 is disengaged from the catch 52. The tank 13 is pulled in the direction of arrow (D) and removed from the casing 1. Water is poured into the tank 13 through the port 14, and is closed by the plug 15. The water-filled tank 13 is placed in the chamber 47, and locked to the casing 1 by the lock unit 53.

The second water channel 22*b* is provided a water intake port 54 at its terminating end, and a tubular flexible portion (e.g. of rubber) in the middle portion so that the water intake port 54 is kept under the water in the tank 13 irrespective of the positions taken by the casing 1.

The handle 2 is provided with a transparent wall portion 56 through which the amount of water is monitored. Otherwise, the coverage of the handle 2 prevents the user from monitoring the amount of water in the tank 13.

As described above, when the top portion 49 of the movable member 44 is withdrawn from the tank 13, the trigger 27 is set free from the support 50. Thus the pump 23 and the tank 13 are connected to each other through the second water channel 22*b*.

At this state, the heater is energized so as to heat the vaporizing chamber 5 to an effective temperature predetermined by the thermostat 7, normally 160° C. to 200° C. The bimetal-fuse 26 attached to the vaporizing chamber 5 remains biased toward the lid 6 until the temperature of the vaporizing chamber 5 reaches the predetermined temperature, but once the temperature is reached, the bimetal-fuse 26 is reversely biased from the lid 6, thereby opening the valve unit 24 to open the first water channel 22*a*.

Since the first water channel 22*a* is closed by the valve unit 24 until the vaporizing chamber 5 is heated to the water vaporizable temperature, the vaporizing chamber 5 is protected against an excessive supply of water due to the user's overworking of the pump unit 23.

After the steamer is ready for use, the pump unit 23 is operated by continuing to press the trigger 27, the water in the tank 13 is introduced into the cylinder 28 through the second water channel 22*b* and the second check valve 34 and then the water can be introduced into the vaporizing chamber 5 through the first check valve 30 and the first water channel 22*a*. After the water is introduced into the cylinder 28, outside air is induced therein through the air intake valve 16 inserted in the tank 13.

The water supplied in the vaporizing chamber 5 is instantaneously vaporized, so that the pressure in the vaporizing chamber 5 and the first water channel 22*a* rises, and is ejected through the steam ejection holes 9.

The temperature of the vaporizing chamber 5 lowers accordingly as the water therein vaporizes. If the pump unit 23 is continuously operated, water is continuously supplied into the vaporizing chamber 5, thereby increasing the pressure in the vaporizing chamber 5 and the first water channel 22*a*. The increased pressure is applied to the first check valve 30 to such an extent that it overcomes the initial pressure applied to close the valve 30. As a result, the pressure in the pump unit 23 toward the vaporizing chamber 5 exceeds the predetermined value and finally reaches to such an extent that the first check valve 30 replaces for the return-flow valve 39 originally set to be stronger than the first check valve 30.

Figure 3:
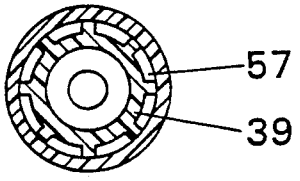
FIG. 3 is a cross-sectional view taken along the line A—A in FIG. 2.
Figure 4:
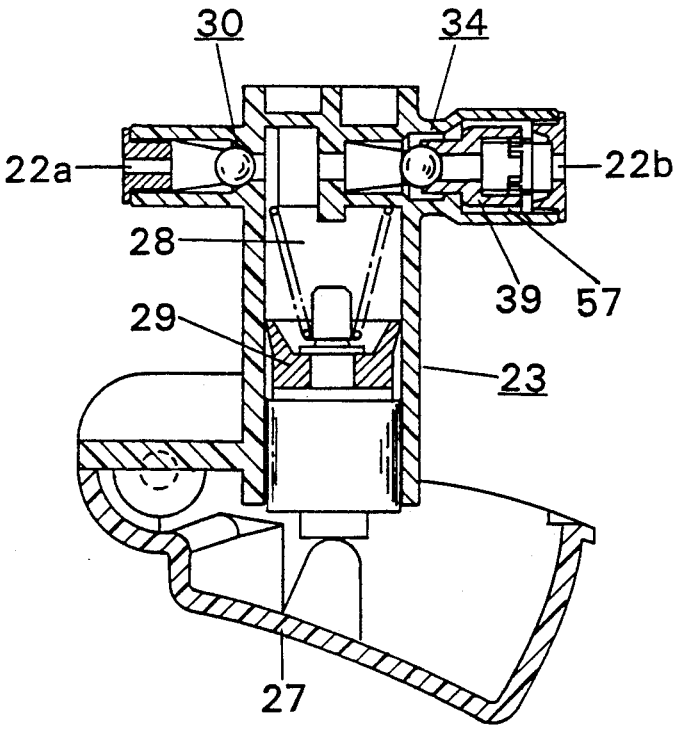
FIG. 4 is a cross-sectional view exemplifying the operation of the return-flow unit.

Referring to FIGS. 3 and 4, the pump unit 23 is still operated, the return-flow valve 39 is operated before the first check valve 30 is opened, thereby sending back the water in the pump unit 23 to the tank 13 through a gap 57 around the return-flow valve 39 and the second water channel 22*b*.

More specifically, referring to FIG. 4 the water entering the cylinder 28 through the second water channel 22*b* and the second check valve 34 is allowed to return to the tank 13 through the return-flow valve 39 and again the second water channel 22*b*. Owing to this circulatory system, a single sealed joint is sufficient for a connection between the tank 13 and the pump unit 23. This simplifies the water circulatory structure and secures a water-tight connection between the tank 13 and the pump unit 23.

While the water circulates in the casing 1, steam is ejected against the clothes through the steam ejection holes 9. The clothes and the users are protected against the leakage of unvaporized hot water.

As is evident from the foregoing description, the imprudent overworking of the pump unit 23, if any, will cause no problem because if the pressure in the vaporizing chamber 5 exceeds a predetermined value, the return-flow unit 38 sends back the water in the pump unit 23 to the tank 13, and if the pressure in the vaporizing chamber 5 drops below the predetermined value as the steam emits, water is automatically supplied to the vaporizing chamber 5.

In the process of ironing clothes, if the vaporizing chamber 5 cools below a water vaporizing temperature, the bimetal-fuse 26 is displaced toward the lid 6, thereby enabling the valve unit 24 to block the first water channel 22*a* by the spring 25. Thus the supply of water for the vaporizing chamber 5 is stopped. Nevertheless, the return-flow unit 38 continues to return the water to the tank 13, thereby avoiding the over-charge of water in the first water channel 22*a* owing to any imprudent overworking of the pump unit 23 by the user.

Figure 11:
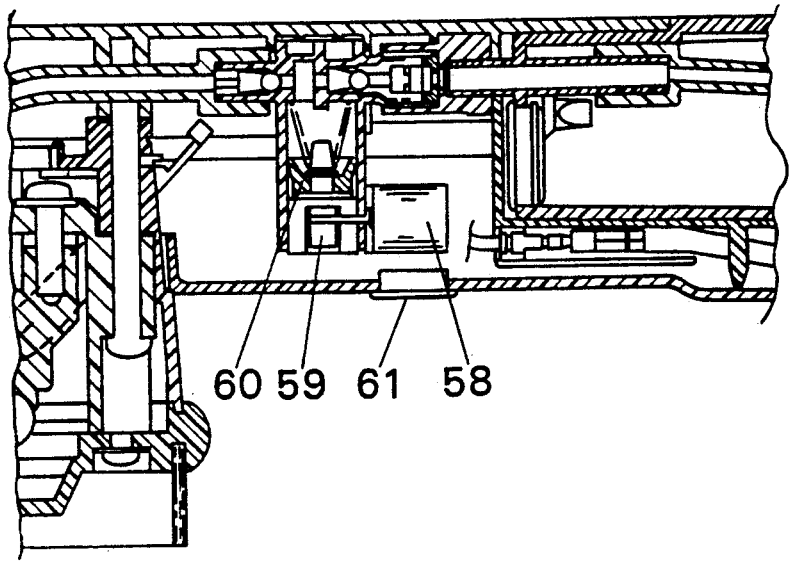
FIG. 11 is a cross-sectional view showing a modified version of the water supply unit.

In the illustrated embodiment the water in the tank is manually supplied to the vaporizing chamber 5; more specifically, the trigger 27 is continuously pressed by hand. However, the embodiment is not limited to the manual operation of the trigger but the water supply can be electrically performed; that is, by use of an on-off switch. For example, as shown in FIG. 11, the motor 58 can be provided with a fixed cam 59 which is intended to push the piston 60. The changeover between the supply and the stoppage of water can be easily effected by the switch 61.

The electrical water supply system requires some device whereby the system is kept inoperative when the tank 13 is not present on the casing 1. One proposal is that the movable member 44 may be modified so as to operate another switch (not shown) to deenergize the motor. In addition, the electrical system can be designed to operate only when the tank 13 is mounted on the casing 1.

Figure 12:
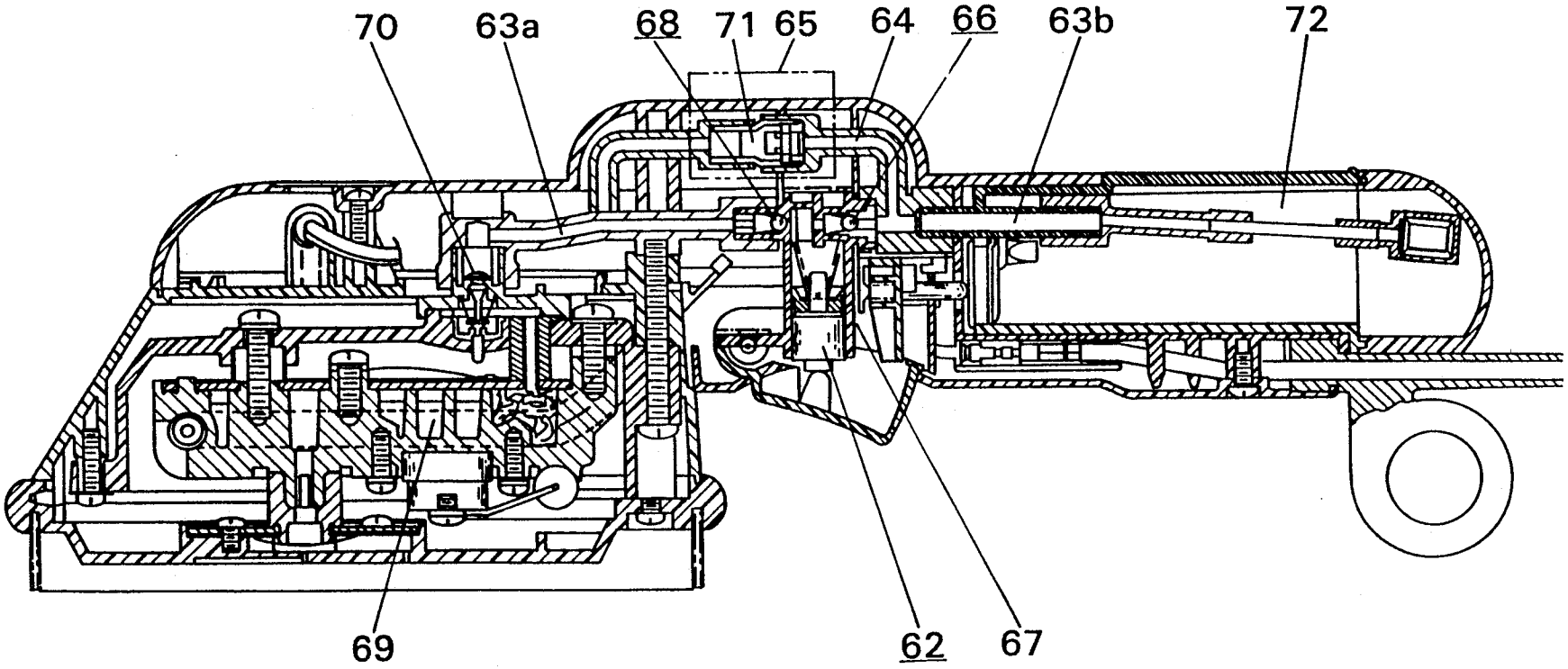
FIG. 12 is a cross-sectional view showing a modified version of the return-flow unit.

FIG. 12 shows a modified version of the return-flow unit 38 in which a first water channel 63*a* and a second water channel 63*b* do not pass through the pump unit 62, and are connected to a third water channel 64 including a return-flow unit 65. Under this system the water entering a cylinder 67 is supplied to the vaporizing chamber 5 through a first check valve 68 and the first water channel 63*a*. When the first water channel 63*a* is closed by the valve unit 70, or when the pump 62 continues to supply water irrespective of the increasing pressure in the vaporizing chamber 69 and the first water channel 63*a*, since the water is prevented by the closed first check valve 68 from flowing into the pump unit 62, a return-flow valve 71 may be alternatively opened so that the water is returned to the tank 72 through the third water channel 64 and the second water channel 63*b*.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A steamer with controlled pressure for use in ironing clothes, the steamer comprising a casing, a vaporizing chamber accommodated in the casing, a water tank mounted on the casing, a water supply means for supplying the water in the tank to the vaporizing chamber, a water channel connection between the tank and the vaporizing chamber, a valve means for preventing the water from returning to the tank, the valve means being located in the water supply means toward the tank, and a return-flow means for returning the water supplied by the water supply means to the tank, said return-flow means responsive to the pressure in the vaporizing chamber exceeding a predetermined value.

2. A steamer according to claim 1, wherein the water supply means and the return-flow means are made in one piece.

3. A steamer according to claim 1, wherein the return-flow means is provided on the tank and is connected to the water supply means.

4. A steamer according to claim 1, wherein the return-flow means is provided in a water channel connecting a first point of the water supply means toward the vaporizing chamber and a second point thereof toward the tank.

5. A steamer according to claim 1, wherein the return-flow means comprises a channel such that the water in the tank is returned to the tank from a point where the water is supplied to the water supply means.

6. A steamer according to claim 1, wherein the water supply means comprises a pump unit including cylinder, a piston reciprocally movable in the cylinder, and a switch for manually operating the piston.

7. A steamer according to claim 1, wherein the water supply means is electrically operated.

8. A steamer according to claim 1, further comprising a stopping means for keeping the water supply means inoperative in response to the dismount of the tank from the casing.

9. A steamer according to claim 1, wherein the casing comprises a grip portion having a sufficient space to accommodate the tank in a detachable manner.

10. A steamer according to claim 1, wherein the vaporizing chamber includes a steam ejection section for ejecting steam generated in the vaporizing chamber, and wherein the valve means includes a bimetallic element whereby the opening or closing of the water channel is quickly performed.

11. A steamer according to claim 1, wherein the vaporizing chamber is covered with a cover made of a metallic thermal conductor, the cover comprising a bimetallic element.

12. A steamer according to claim 1 wherein the water tank is detachably mounted in the casing, further comprising a first stopping means for closing the water channel and stopping the water supply for the vaporizing chamber in response to changes in the temperatures of the vaporizing chamber port, and a second stopping means for keeping the water supply means inoperative when the tank is dismounted from the casing.

13. A steamer with controlled pressure for use in ironing clothes, the steamer comprising a casing, a vaporizing chamber in the casing, a water tank mounted on the casing, a pump means for supplying the water in the tank to the vaporizing chamber, a water channel connection between the tank and the vaporizing chamber, a first valve means for preventing the water from returning to the pump means, the first valve means being disposed in the pump means toward the vaporizing chamber, a second valve means for preventing the water from returning to the tank, the second valve means being disposed in the pump means toward the tank, and a third valve means for returning the water in the pump means to the tank when the pressure in the vaporizing chamber exceeds a predetermined value or when the channel connection between the pump means and the vaporizing chamber is closed.

14. A steamer with controlled pressure for use in ironing clothes, the steamer comprising a casing, a vaporizing chamber in the casing, a water tank mounted on the casing, a pump means for supplying the water in the tank to the vaporizing chamber, a first water channel connecting the pump means and the tank, a second water channel connecting the pump means and the vaporizing chamber, a first valve means for preventing the water from returning to the pump means, the first valve means being disposed in the pump means toward the vaporizing chamber, a second valve means for preventing the water from returning to the tank, the second valve means being disposed in the pump means toward the tank, and a third valve means for returning the water in the pump means to the tank when the pressure in the vaporizing chamber exceeds a predetermined value or when the channel connection between the pump means and the vaporizing chamber is closed, the second valve means and the third valve means being disposed in the first water channel.

15. A steamer with controlled pressure for use in ironing clothes, the steamer comprising a casing, a vaporizing chamber, a tank having a water intake port, a pump means for supplying the water in the tank to the vaporizing chamber, an air intake valve for taking in air in accordance with a reduction in the pressure in the tank, the air intake valve having a lid, a plug for closing or opening the water intake port, the air intake valve and the lid being made in one piece.

16. A steamer according to claim 15, wherein the air intake valve is located under the water in the tank at a point adjacent to the water intake, and wherein the cover is connected to the air intake valve.

17. A steamer with controlled pressure for use in ironing clothes, the steamer comprising a casing, a vaporizing chamber, a tank detachably mounted on the casing, a water supply means for supplying the water in the tank to the vaporizing chamber, a water channel connecting the tank and the vaporizing chamber, a valve means for preventing the water from returning to the tank, the valve means being disposed on the water supply means toward the tank, a return-flow means for returning the water from the water supply means to the tank when the pressure in the vaporizing chamber exceeds a predetermined value, and a stopping means for keeping the water supply means inoperative, the stopping means responsive to the tank being dismounted from the casing.

* * * * *